US008808615B2

(12) United States Patent
Lee

(10) Patent No.: US 8,808,615 B2
(45) Date of Patent: Aug. 19, 2014

(54) TUYERE FOR IRON MAKING FURNACE

(75) Inventor: Hae-Yang Lee, Incheon (KR)

(73) Assignee: Seoul Engineering Co., Ltd, Incheon (KR)

( * ) Notice: Subject to any disclaimer, the term of this patent is extended or adjusted under 35 U.S.C. 154(b) by 249 days.

(21) Appl. No.: 13/214,477

(22) Filed: Aug. 22, 2011

(65) Prior Publication Data

US 2012/0187613 A1 Jul. 26, 2012

(30) Foreign Application Priority Data

Jan. 24, 2011 (KR) ..... 10-2011-0006630

(51) Int. Cl.
*C21B 7/16* (2006.01)

(52) U.S. Cl.
USPC ..... 266/241; 266/270

(58) Field of Classification Search
USPC ..... 266/241, 265, 270
See application file for complete search history.

(56) References Cited

U.S. PATENT DOCUMENTS

| | | | | |
|---|---|---|---|---|
| 6,446,565 | B2 * | 9/2002 | Stricker et al. | 110/182.5 |
| 7,550,109 | B2 * | 6/2009 | Lee | 266/270 |
| 2012/0187613 | A1 * | 7/2012 | Lee | 266/270 |

* cited by examiner

*Primary Examiner* — Scott Kastler
(74) *Attorney, Agent, or Firm* — Jeffrey L. Snow; Cooper & Dunham LLP

(57) ABSTRACT

A tuyere for an iron making furnace, including a body unit having a blast passage passing through a central axis thereof, wherein the body unit includes: a frusto-conical body having a main body cooling passage; and a protruding part protruding from the body, wherein the tuyere further includes: a cover unit combined with the protruding part and defining a tip body cooling passage between the cover unit and the outer circumferential surface of the protruding part; and an outer unit combined with the cover unit while surrounding the cover unit and defining an outer cooling passage therein. When the outer unit is partially damaged, although the cooling water supply to the damaged part is cut off, the function of the tuyere can be continuously performed both by the remaining part of the outer unit and by the body unit, thereby providing a tuyere having a lengthened life span.

10 Claims, 6 Drawing Sheets

TUYERE FOR IRON MAKING FURNACE

BACKGROUND OF THE INVENTION

1. Field of the Invention

The present invention relates, in general, to a tuyere for an iron making furnace and, more particularly, to a tuyere for an iron making furnace, which can supply air, oxygen or a fuel, such as pulverized coal, into the iron making furnace, so that the charged fuel can be burned and iron ore smelted inside the furnace, and which has an increased life span.

2. Description of the Related Art

Generally, an iron making process is a process in which coke is used as a fuel and an iron ore is used as a raw material and these are charged into an iron making furnace through a charging inlet and hot air is introduced into the furnace through a blast passage of a tuyere provided in a lower part of the furnace, so that the charged coke burns and the iron ore is reduced and smelted, and thereby producing molten iron that is a hot melt.

In a conventional iron making furnace, the tuyere for introducing hot air into the furnace is typically made of pure copper. Although the melting point of pure copper is 1,083° C. which is a somewhat low melting point, cooling water is circulated in the copper tuyere at a high speed so that the copper tuyere can resist the heat of the hot air having a high temperature of about 1,200° C. which is being introduced into the iron making furnace through the tuyere.

To introduce hot air into the iron making furnace, the tuyere is provided in the wall of the furnace. Here, to realize a desired airtight structure of the tuyere regardless of the internal pressure of the furnace, the tuyere is typically installed to protrude inwards into the furnace after being combined with a tuyere cooler. Because the tuyere has an inward protruding structure as mentioned above, the tuyere must be prevented from being fused or damaged by heat inside the furnace. Accordingly, the tuyere is typically provided with a water cooling system, in which cooling water is introduced into the tuyere through an inlet and circulates through a cooling passage while cooling the tuyere prior to being discharged from the tuyere through an outlet.

Further, the conventional tuyere has a frusto-conical shape and is fabricated with a body unit and a tip part combined with the tip of the body unit, so that, when the hot melt flows down along the inner surface of the wall of the iron making furnace, the hot melt comes into contact with the tip part of the tuyere and may erode or damage the tip part. When the tip part of the tuyere has been eroded or damaged as described above, cooling water stops being supplied into the tip part so as to prevent the cooling water from flowing into the furnace, but the cooling water is supplied only to the body unit, thereby reducing the cooled area of the tuyere and reducing the cooling efficiency. Further, because the tip part is not cooled, the life span of the tuyere is shortened.

SUMMARY OF THE INVENTION

Accordingly, the present invention has been made keeping in mind the above problems occurring in the related art, and the present invention is intended to propose a tuyere for an iron making furnace, in which, when the outer unit of the tuyere is partially damaged, although the cooling water stops being supplied to the damaged part of the outer unit, the desired function of the tuyere can be continuously performed both by the remaining part of the outer unit and by the body unit, thereby lengthening the life span of the tuyere, and in which, the cooling water can be evenly distributed to the tip of the tuyere, thereby realizing excellent cooling efficiency, and in which, the time that the tuyere can be used to perform work is lengthened, thereby increasing work efficiency of the iron making furnace.

In order to achieve the above object, according to one aspect of the present invention, there is provided a tuyere for an iron making furnace, including a body unit having a blast passage passing through a central axis thereof, wherein the body unit includes: a frusto-conical body having a main body cooling passage therein; and a protruding part protruding from the body, wherein the tuyere further includes: a cover unit combined with the protruding part and defining a tip body cooling passage between the cover unit and an outer circumferential surface of the protruding part; and an outer unit combined with the cover unit while surrounding the cover unit and defining an outer cooling passage therein.

The tuyere for the iron making furnace may further include: at least one additional outer unit externally combined with the outer unit and defining an additional outer cooling passage therein.

Here, the outer unit may be provided in a tip thereof with a passage groove for defining a lowest course of the outer cooling passage.

Further, the outer circumferential surface of the protruding part may be provided with a cover unit locking protrusion.

Further, the cover unit may have a flat inner surface and may be provided on an outer surface thereof with a plurality of partitions for defining the outer cooling passage.

Further, the outer unit may be provided on an outer circumferential surface thereof with a plurality of second partitions for defining the additional outer cooling passage.

Further, the main body cooling passage and the tip body cooling passage may be configured in the form of a spiral channel or a ribbed channel.

Further, the outer cooling passage may be configured in the form of a spiral channel.

Further, the outer unit may be equipped on an upper part, a lower part and a tip thereof with a hard facing.

Here, the hard facing may be provided on the upper part of the outer unit within a range of 150~250 mm from the tip of the outer unit and may be provided on the lower part of the outer part within a range of 100~150 mm from the tip of the outer unit.

As described above, in the tuyere for the iron making furnace according to the present invention, the cover unit is combined with the protruding part of the body unit and defines the tip body cooling passage, and the outer unit having the outer cooling passage therein is combined with the cover unit in such a way the outer unit covers both the outer circumferential surface of the cover unit and the tip of the protruding part and, therefore, when the outer unit of the tuyere is partially damaged, although cooling water is no longer supplied to the damaged part of the outer unit, the desired function of the tuyere can be continuously performed both by the remaining part of the outer unit and by the body unit, thereby providing a tuyere having a lengthened life span. Further, in the present invention, the cooling water can be evenly distributed to the tip of the tuyere, thereby realizing excellent cooling efficiency, and the work time of the tuyere can be lengthened, thereby increasing work efficiency of the iron making furnace.

BRIEF DESCRIPTION OF THE DRAWINGS

The above and other objects, features and other advantages of the present invention will be more clearly understood from the following detailed description when taken in conjunction with the accompanying drawings, in which:

FIGS. 4A to 4C are side sectional views of the tuyere according to the first embodiment of the present invention shown in FIG. 1, in which FIG. 4A is a view showing the flow of cooling water in a body unit cooling passage; FIG. 4B is a view showing the flow of the cooling water in a first outer cooling passage; and FIG. 4C is a view showing the flow of the cooling water in a second outer cooling passage;

FIGS. 7A to 7C are sectional views of the tuyere according to the second embodiment of the present invention taken along arrows AA in FIG. 5, in which FIG. 7A is a sectional view of a body unit; FIG. 7B is a sectional view of an outer unit; and FIG. 7C is a sectional view showing the flow of the cooling water in a spiral cooling passage defined in the outer unit.

DETAILED DESCRIPTION OF THE INVENTION

Hereinbelow, the construction of the present invention will be described in detail with reference to the accompanying drawings.

In a tuyere for an iron making furnace according to the present invention, a cover unit is combined with a protruding part of a body unit, thereby defining a body cooling passage, and an outer unit is combined with the cover unit while surrounding the cover unit, so that, when the outer unit is partially damaged, although the cooling water stops being supplied to the damaged part of the outer unit, the desired function of the tuyere can be continuously performed both by the remaining part of the outer unit and by the body unit, thereby providing a tuyere having an increased life span, and the cooling water can be evenly distributed to the tip of the tuyere, thereby realizing excellent cooling efficiency, and the work time of the tuyere can be lengthened, thereby increasing work efficiency of the iron making furnace.

Figure 1:
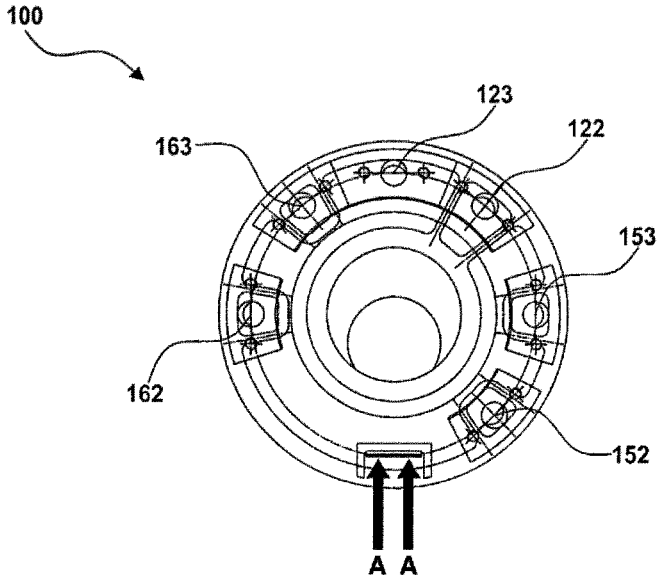
FIG. 1 is a front view illustrating a tuyere according to a first embodiment of the present invention.
Figure 2:
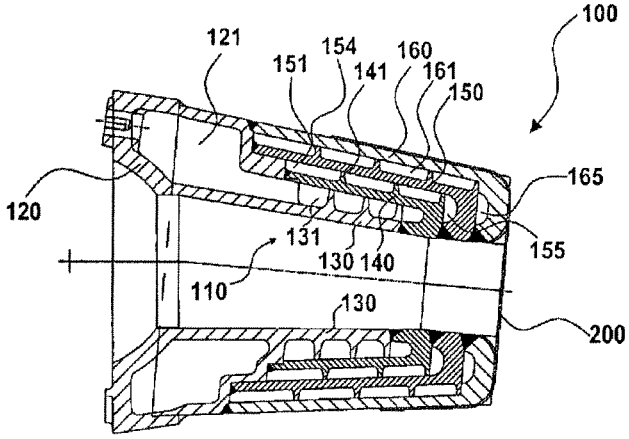
FIG. 2 is a side sectional view of the tuyere according to the first embodiment of the present invention shown in FIG. 1.

As shown in FIG. 1 and FIG. 2, the tuyere 100 for the iron making furnace according to the first embodiment of the present invention includes: a body unit 110 having a body 120 and a protruding part 130 formed in the tip of the body 120; a cover unit 140; and an outer unit 150. The tuyere may further include a second outer unit fitted over the first outer unit 150 in an effort to further lengthen the life span of the tuyere. Here, the iron making furnace in which the tuyere of the present invention is used may be a blast furnace, a FINEX furnace or a COREX furnace.

Air, oxygen or a fuel, such as pulverized coal, can be introduced into the furnace through the center of the body unit 110 having both the body 120 and the protruding part 130, and each of the body 120 and the protruding part 130 is shaped into the form of a frusto-conical structure.

Figure 3A:
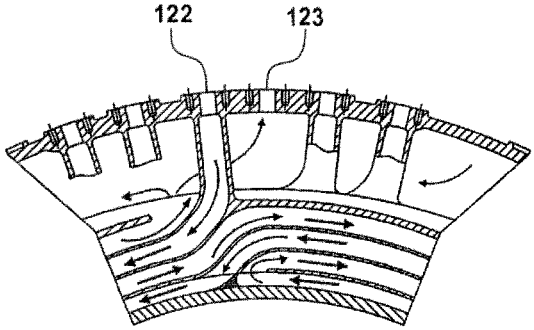
FIGS. 3A to 3C are sectional views of the tuyere according to the first embodiment of the present invention taken along arrows AA in FIG. 1, in which the flow of cooling water in the cooling passages defined both in the body unit and in the outer unit of the tuyere is shown.

Here, a main body cooling passage 121 is defined inside the body 120, the cover unit 140 is fitted over the protruding part 130, with a tip body cooling passage 131 defined between the protruding part 130 and the cover unit 140. As shown in FIG. 3A, cooling water which has been supplied to the tuyere sequentially through the cooling water supply pipe (not shown) and a body inlet 122 circulates through the main body cooling passage 121 and the tip body cooling passage 131, so that the cooling water can absorb heat from the hot tuyere heated by the hot iron making furnace and is discharged from the tuyere through a body outlet 123. Here, the temperature of the outlet cooling water is increased to above that of the inlet cooling water, so that it is noted that the iron making furnace loses a substantial amount of thermal energy by the cooling water.

Here, the main body cooling passage 121 and the tip body cooling passage 131 may be configured as a spiral passage or a ribbed passage, and, in the above state, the cooling water can flow through the spiral passage or through the ribbed passage in the tuyere, thereby realizing excellent cooling efficiency for the tuyere.

In the tuyere 100 for the iron making furnace according to the present invention, the frusto-conical body unit 110 is installed in the wall of the iron making furnace. Here, to realize a desired airtight structure of the tuyere regardless of internal pressure of the furnace, the tuyere is installed to protrude inward in the furnace after being combined with a tuyere cooler. Further, a step part 170 is defined in the junction between the body 120 and the protruding part 130 of the body unit 110, and ends of both the cover unit 140 and the outer unit 150 are joined to the step part 170.

Further, the protruding part 130 is combined with the inner surface of the cover unit 140. The inner surface of the cover unit 140 is a flat surface and the outer surface of the cover unit 140 is provided with a plurality of partitions 141 for defining the outer cooling passage 151.

Further, the outer unit 150 has an annular shape and is combined both with the cover unit 140 and with the protruding part 130 in such a way that the outer unit 150 surrounds both the outer circumferential surface of the cover unit 140 and the tip of the protruding part 130. Further, the outer cooling passage 151 is defined between the cover unit 140 and the outer unit 150, so that the protruding part 130 of the tuyere can be efficiently cooled.

Here, it is preferred that the outer cooling passage 151 be configured in the form of a spiral structure, and this causes the cooling water to flow in the outer part of the tuyere in a spiral passage, thereby realizing excellent cooling efficiency over the entire area of the tuyere.

Figure 3B:
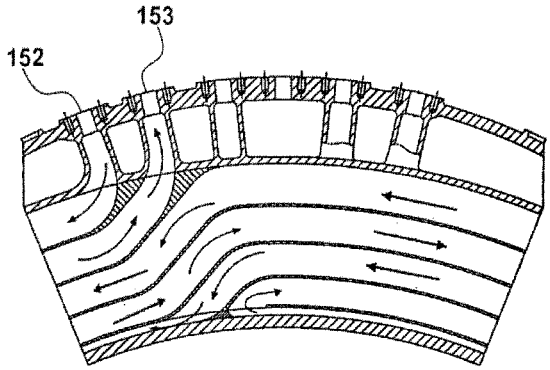

As shown in FIG. 3B, the cooling water is supplied into the outer cooling passage 151 through an outer inlet 152 and the inlet cooling water circulates through the outer cooling passage 151 prior to being discharged from the outer cooling passage 151 through an outer outlet 153.

Further, the tip of the outer unit 150 is provided with a passage groove 155 that defines the lowest course of the outer cooling passage 151, thereby efficiently cooling the outer part of the tuyere and the tip of the tuyere and thereby further increasing the cooling efficiency.

Further, it is preferred that at least one additional outer unit be combined with the outer surface of the outer unit 150 in an effort to increase the life span of the tuyere even more. In the above state, even when the additional outer unit placed in the outermost part of the tuyere is broken, both the body unit 110 and the remaining outer unit can perform the cooling function in a state in which the supply of cooling water to the cooling passage of the broken outer unit is stopped, so that the tuyere can be continuously used.

Figure 3C:
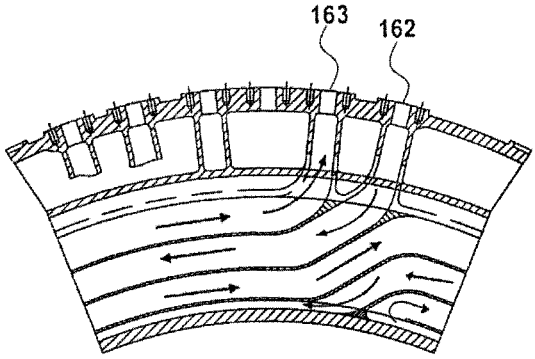

Described in detail, as shown in FIG. 2 and FIG. 3C, a second outer unit 160 may be fitted over the outer circumferential surface of the first outer unit 150. In the above case, a plurality of second partitions 154 may be formed on the outer circumferential surface of the outer unit 150 so as to define a second outer cooling passage 161. Therefore, the cooling water circulates through the second outer cooling passage 161 defined between the first outer unit 150 and the second outer unit 160.

Further, the second outer unit 160 is combined with the first outer unit 150 in such a way that the second outer unit 160 surrounds the tip and the outer circumferential surface of the first outer unit 150. Here, the junction between the body 120 and the protruding part 130 of the body unit 110 is shaped in the form of a double-stepped structure, in which a second step part 171 is formed outside the first step part 170 so that one end of the second outer unit 160 is combined with the second step part 171 while being fitted over the first outer unit 150.

Further, a second passage groove 165 is formed between the inner surface of the tip of the second outer unit 160 and the outer surface of the tip of the first outer unit 150 and defines the lowest course of the second outer cooling passage 161, thereby efficiently cooling the outermost part of the tuyere and the tip of the tuyere and thereby further increasing the cooling efficiency.

Here, it is preferred that the second outer cooling passage 161 be configured to allow the cooling water to spirally circulate in the outer part of the tuyere and thereby increase the cooling capacity.

Figure 4A:
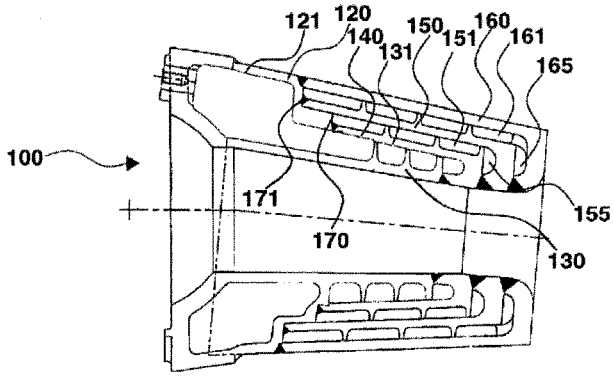
Figure 4B:
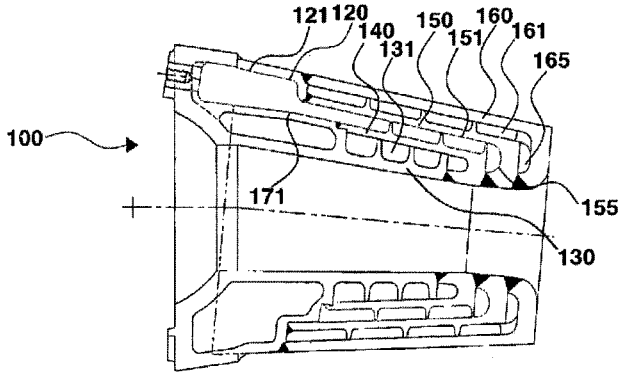
Figure 4C:
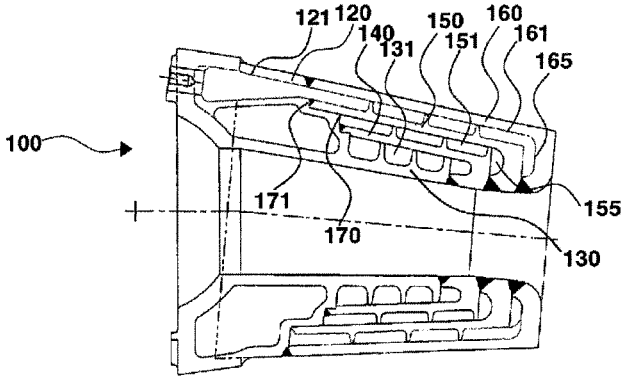

The flow of the cooling water in the cooling passage according to the first embodiment of the present invention is clearly shown in FIGS. 4A, 4B and 4C.

Further, in the present invention, a plurality of additional outer units having respective outer cooling passages may be sequentially fitted over the second outer unit 160 in an effort to further increase the cooling efficiency of the tuyere and to further increase the life span of the tuyere.

Figure 5:
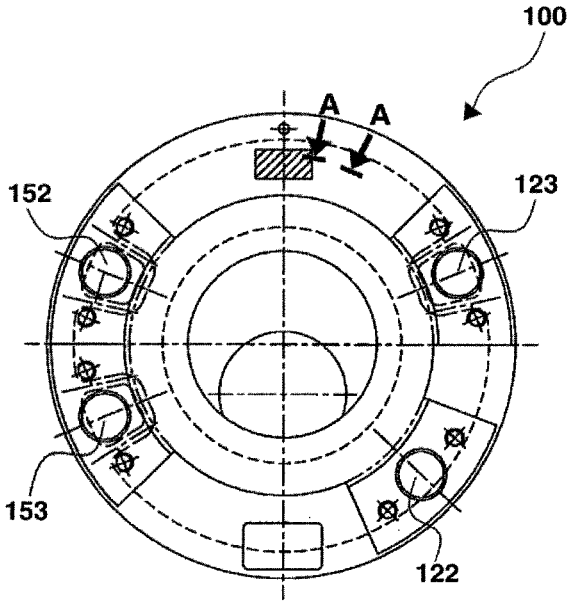
FIG. 5 is a front view illustrating a tuyere according to a second embodiment of the present invention.
Figure 6:
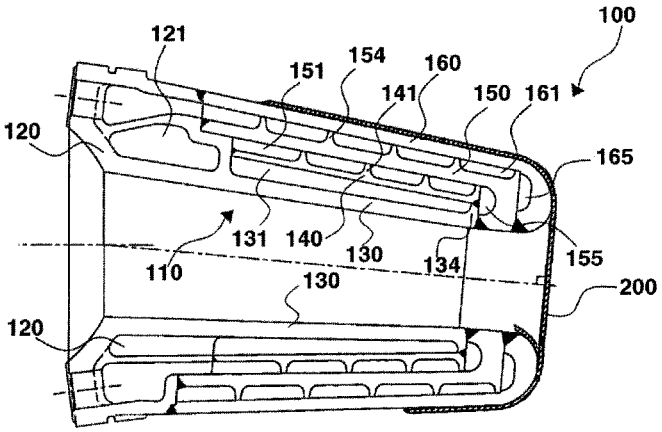
FIG. 6 is a side sectional view of the tuyere according to the second embodiment of the present invention shown in FIG. 5.

FIG. 5 and FIG. 6 illustrate a tuyere for an iron making furnace according to the second embodiment of the present invention. As shown in the drawings, the tuyere according to the second embodiment includes: a main body cooling passage 121 defined inside a body 120 of a body unit 110; a cover unit 140 fitted over a protruding part 130; and a tip body cooling passage 131 defined between the outer circumferential surface of the protruding part 130 and the cover unit 140.

Figure 7A:
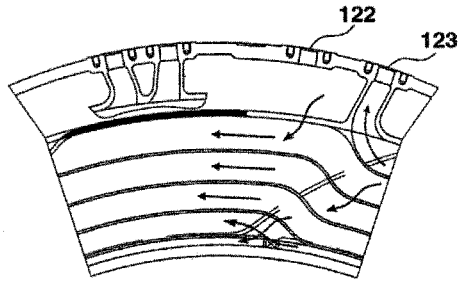
Figure 7B:
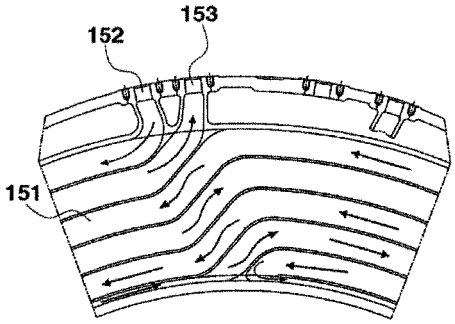
Figure 7C:
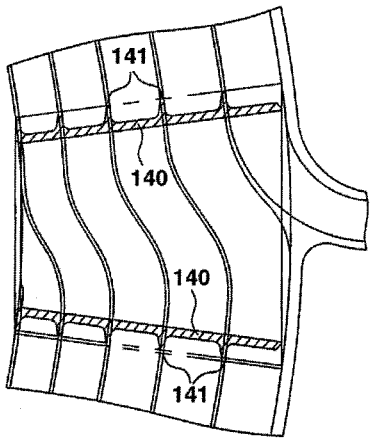

Here, as shown in FIGS. 7A, 7B and 7C, cooling water that has been introduced to a body inlet 122 of the tuyere through a cooling water supply pipe (not shown) sequentially circulates through the main body cooling passage 121, a tip body cooling passage 131, an outer cooling passage 151 and a passage groove 155 prior to being discharged from the tuyere through a body outlet 123, so that the cooling water can reduce the temperature of the tuyere heated by the high temperature heat inside the iron making furnace.

Of course, it is preferred that each of the main body cooling passage 121 and the tip body cooling passage 131 be shaped in the form of a spiral channel or a ribbed channel. Further, the outer cooling passage 151 is preferably shaped in the form of a spiral channel, as shown in FIG. 7C. Therefore, the cooling water can circulate through the spiral and/or ribbed channels in the tuyere and can realize the excellent cooling efficiency throughout the entirety of the tuyere.

Further, a cover unit locking protrusion 134 is provided on the outer circumferential surface of the protruding part 130, so that the inner surface of the cover unit 140 can be locked thereto. Here, the inner surface of the cover unit 140 is a flat surface and the outer surface of the cover unit 140 is provided with a plurality of partitions 141 for defining the outer cooling passage 151.

Figure 8:
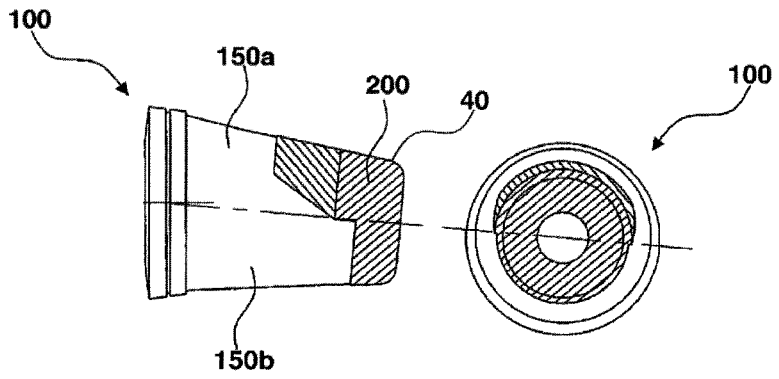
FIG. 8 is a view showing a tuyere provided with a hard facing according to a further embodiment of the present invention.

Further, as shown in FIG. 8, the tip of the outer unit 40 is provided with a hard facing 200 for minimizing the erosion or breakage of the tip of the tuyere even when the tip of the tuyere collides with fuel and raw material which drop from a charging inlet provided in the upper end of the iron making furnace.

Here, it is preferred that the hard facing 200 be made of an Fe—Cr material having high heat resistance and high abrasion resistance, and the hard facing 200 be formed on an upper part 150*a* of the outer unit 150 within a range of 150~250 mm length from the tip of the outer unit and be formed on a lower part 150*b* of the outer unit 150 within a range of 100~150 mm from the tip of the outer unit.

The reason for the above-mentioned difference in the covering range of the hard facing 200 is that the area of the upper part 150*a* of the outer unit influenced both by the high temperature heat and by the falling of material inside the furnace is typically larger and thereby the upper part 150*a* may easily melt and/or be severely damaged, so that it is preferred that the upper part 150*a* be equipped with the hard facing 200 within the range of 150~250 mm from the tip of the outer unit so as to minimize the damage to the upper part 150*a*; however, the influenced area of the lower part 150*b* of the outer unit is typically shorter than the upper part 150*a*, so that the lower part 150*b* may be equipped with the hard facing 200 within the range of 100~150 mm from the tip of the outer unit.

As described above, the tuyere 100 for the iron making furnace according to the present invention is advantageous in that the cover unit is combined with the protruding part of the body unit and defines the tip body cooling passage, and the outer unit having the outer cooling passage therein is combined with the cover unit in such a way the outer unit covers both the outer circumferential surface of the cover unit and the tip of the protruding part and, therefore, when the outer unit of the tuyere is partially damaged, cooling water stops being supplied to the damaged part of the outer unit; however, the desired function of the tuyere can be continuously performed both by the remaining part of the outer unit and by the body unit, thereby providing a tuyere having a lengthened life span. Further, in the present invention, the cooling water can be evenly distributed to the tip of the tuyere, thereby realizing excellent cooling efficiency, and the work time of the tuyere can be lengthened, thereby increasing work efficiency of the iron making furnace.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A tuyere for an iron making furnace having a blast passage passing through a central axis thereof, comprising:

a body unit having a frusto-conical body, a main body cooling passage therein, the main body cooling passage configured as a spiral cooling passage, and a protruding part protruding from the tip of the body and having an outer circumferential surface;

a cover unit having an outer circumferential surface and combined with the protruding part to define a tip body cooling passage between the cover unit and the outer circumferential surface of the protruding part, the tip body cooling passage being configured as a spiral passage and communicating with the main body cooling passage; and a first outer unit having an outer circumferential surface and combined with the cover unit and surrounding the cover unit to define a first outer cooling passage between the first outer unit and the outer circumferential surface of the cover unit, the first outer cooling passage being configured as a spiral passage and being isolated from the tip body cooling passage;

wherein the first outer cooling passage defines:

a first outer inlet of the tuyere such that a cooling water may be supplied through the first outer inlet; and a first outer outlet of the tuyere such that the cooling water supplied through the first outer inlet may be discharged from the first outer outlet, and wherein the first outer unit includes a tip thereof with a first outer passage groove defining a lowest course of the first outer cooling passage, the first outer passage groove connecting the first outer inlet cooling passage to the first outer outlet.

2. The tuyere for the iron making furnace as set forth in claim 1, further comprising:

a second outer unit externally combined with the first outer unit to define a second outer cooling passage between the second outer unit and the outer circumferential surface of the first outer unit, the second outer cooling passage being isolated from the tip body cooling passage and the first outer cooling passage.

3. The tuyere for the iron making furnace as set forth in claim 2, wherein the second outer cooling passage comprises:

a second outer inlet of the tuyere such that a cooling water may be supplied through the second outer inlet; and a second outer outlet of the tuyere such that the cooling water supplied through the second outer inlet may be discharged from the second outer outlet, wherein the second outer unit includes a tip thereof with a second outer passage groove for defining a lowest course of the second outer cooling passage, the second outer passage groove connecting the second outer inlet to the second outer outlet.

4. The tuyere for the iron making furnace as set forth in claim 1, wherein the outer circumferential surface of the protruding part is provided with a cover unit locking protrusion.

5. The tuyere for the iron making furnace as set forth in claim 1, wherein the cover unit has a flat inner surface and is provided on an outer surface thereof with a plurality of partitions for defining the first outer cooling passage.

6. The tuyere for the iron making furnace as set forth in claim 2, wherein the first outer unit is provided on an outer circumferential surface thereof with a plurality of second partitions for defining the second outer cooling passage.

7. The tuyere for the iron making furnace as set forth in claim 1, wherein the tip body cooling passage and the first outer cooling passage are positioned around the blast passage and the first outer cooling passage is positioned around the tip body cooling passage.

8. The tuyere for the iron making furnace as set forth in claim 2, wherein the second outer unit is equipped with an upper part, a lower part and a tip thereof with a hard facing.

9. The tuyere for the iron making furnace as set forth in claim 8, wherein the hard facing is provided on an upper part of the second outer unit within a range of 150~250 mm from a tip of the second outer unit and is provided on a lower part of the second outer part within a range of 100~150 mm from the tip of the second outer unit.

10. A tuyere for an iron making furnace having a blast passage passing through a central axis thereof, comprising:

a body unit having a frusto-conical body, a main body cooling passage therein and a protruding part protruding from the tip of the body and having an outer circumferential surface;

a cover unit having an outer circumferential surface and combined with the protruding part to form a tip body cooling passage between the cover unit and the outer circumferential surface of the protruding part, the tip body cooling passage communicating with the main body cooling passage;

a first outer unit having an outer circumferential surface and combined with the cover unit while surrounding the cover unit to define a first outer cooling passage between the first outer unit and the outer circumferential surface of the cover unit, the first outer cooling passage being configured in the form of a spiral channel extended along the longitudinal direction of the tuyere and communicating with the tip body cooling passage; and a second outer unit externally combined with the first outer unit while surrounding the first outer unit to define a second outer cooling passage between the second outer unit and the outer circumferential surface of the first outer unit, the second outer cooling passage being isolated from the tip body cooling passage and the first outer cooling passage, wherein the second outer cooling passage defines:

an outer inlet of the tuyere such that a cooling water may be supplied through the outer inlet; and an outer outlet of the tuyere such that the cooling water supplied through the outer inlet may be discharged from the outer outlet, wherein the first outer unit includes a tip thereof with a first outer passage groove, the first outer passage groove being positioned between the tip body cooling passage and the first outer cooling passage to connect the first outer cooling passage to the tip body cooling passage, and wherein the second outer unit includes a tip thereof with a second outer passage groove defining a lowest course of the second outer cooling passage, the second outer passage groove connecting the outer inlet to the outer outlet.

* * * * *